US006368499B1

(12) United States Patent
Sharpless

(10) Patent No.: US 6,368,499 B1
(45) Date of Patent: Apr. 9, 2002

(54) STORM DRAIN ASSEMBLY WITH DISPOSABLE FILTER CARTRIDGE

(76) Inventor: S. Robert Sharpless, 333 Beaumont Rd., Devon, PA (US) 19333

( * ) Notice: Subject to any disclaimer, the term of this patent is extended or adjusted under 35 U.S.C. 154(b) by 0 days.

(21) Appl. No.: 09/656,161

(22) Filed: Sep. 6, 2000

(51) Int. Cl.[7] ..... E03F 5/06

(52) U.S. Cl. ..... 210/164; 210/266; 210/282; 210/924; 404/4

(58) Field of Search ..... 210/163, 164, 210/242.2, 266, 282, 924, 691, 693; 404/4, 5

(56) References Cited

U.S. PATENT DOCUMENTS

| | | | | | |
|---|---|---|---|---|---|
| 530,816 | A | * | 12/1894 | Wright | 210/164 |
| 2,615,526 | A | * | 10/1952 | Lane | 210/164 |
| 5,022,802 | A | * | 6/1991 | Juhl et al. | 210/282 |
| 5,186,831 | A | * | 2/1993 | De Petris | 210/924 |
| 5,223,154 | A | | 6/1993 | MacPherson Jr., et al. | 210/790 |
| 5,284,580 | A | | 2/1994 | Shyh | 210/163 |
| 5,372,714 | A | | 12/1994 | Logue, Jr. | 210/164 |
| 5,403,474 | A | | 4/1995 | Emery | 210/163 |
| 5,462,785 | A | * | 10/1995 | Holland | 210/924 |
| 5,511,904 | A | * | 4/1996 | Van Egmond | 210/164 |
| 5,788,849 | A | * | 8/1998 | Hutter, Jr. et al. | 210/163 |
| 5,820,762 | A | * | 10/1998 | Bamer et al. | 210/163 |
| 5,849,198 | A | * | 12/1998 | Sharpless | 210/164 |
| 5,925,241 | A | * | 7/1999 | Aldridge et al. | 210/163 |
| 6,106,707 | A | * | 8/2000 | Morris et al. | 210/163 |

* cited by examiner

*Primary Examiner*—Christopher Upton
(74) *Attorney, Agent, or Firm*—LaMorte & Associates

(57) ABSTRACT

A disposable filter cartridge for a storm drain and the filter system that uses the improved filter cartridge are claimed. The filter cartridge has a pillow structure, wherein a water permeable scrim bag surrounds loose oil absorbing fibers. The oil absorbing fibers are preferably fabricated from melt blown polypropylene. The filter cartridge is placed in a filter cage that directs water flow through the filter cartridge yet prevents debris from reaching the filter cartridge. The filter cage is suspended below the grate of the storm drain by suspension elements such as chains or rods. The top of each of the suspension elements terminates at an attachment element that engages the grate of the storm drain. As a result, the filter cage and filter cartridge are suspended directly from the storm drain grate. By suspending the filter cartridge directly from the grate of a storm drain, the filter cartridge is positioned directly in line with the flow of water entering the storm drain.

13 Claims, 2 Drawing Sheets

STORM DRAIN ASSEMBLY WITH DISPOSABLE FILTER CARTRIDGE

BACKGROUND OF THE INVENTION

1. Field of the Invention

In general, the present invention relates to filter cartridges that are contained within the confines of a storm drain. More particularly, the present invention relates to the structure and composition of the filtering material used in such cartridges.

2. Description of the Prior Art

Many modern streets are designed and built with storm drains. The storm drains are periodically located along the curb of the street. The street is graded in such a manner so that any water falling onto the street will flow to one of the storm drains. This prevents water from collecting on the street and inhibiting the flow of traffic along the street.

Traditionally, curbside storm drains contain a catch basin that is connected to a below lying sewer with a large diameter pipe. The catch basin is commonly covered with a grate. The grate enables water to flow into the catch basin but prevents large objects, such as tree branches, from passing into the catch basin and blocking the sewer pipe. The catch basin itself collects debris that is heavier than water but is washed into the storm sewer by the force of flowing water. As a result, storm drains need periodic maintenance, wherein the debris collected in the catch basin is removed.

As water flows over a street to a storm sewer, the water often mixes with oil and other contaminants. The oil may come from automobiles that leak oil. Other petroleum based contaminants include grease, diesel fuel, hydraulic fluid and gasoline. The federal and state environmental protection laws set forth many guidelines governing the disposal of petroleum based contaminants. Generally, it is unlawful to dispose of petroleum based contaminants in the public sewer system or in any other flowing supply of water. As such, the rain runoff that passes into many curb side storm drains fails to meet the state and federal standards due to the petroleum based contaminants that wash into the storm drains with the rain water.

The prior art contains many different types of filter systems that are intended to at least partially purify the runoff water that passes into a storm drain. Certain prior art devices are filters that pass over the grate above the storm sewer. Such a filter is exemplified by U.S. Pat. No. 5,403,474 to Emery, entitled Curb Inlet Gravel Sediment Filter. In such prior art arrangements, the filter itself is accessible above the sewer's grate. Consequently, the filter disrupts the levelness of a street's surface and therefore is only good in certain temporary applications.

Since the catch basins of many storm drains are made of poured cement, it is not practical to change the structure of existing storm drains in order for those storm drains to accept filters. As a result, many filter configurations have been made that are adapted to be added to existing storm sewer designs. In a typical storm sewer, a ledge is formed around the rim of the catch basin. The drain grate rests upon the ledge, thereby covering the open top of the catch basin. The depth of the ledge typically corresponds to the thickness of the grate. As a result, the top of the grate lays in the same plane as does the surface of the street. In the prior art, there are filter structures that hang in the storm drain catch basin below the grate. Typically, such prior art filter structures engage the same ledge of the catch basin that supports the grate. As a result, a portion of the filter structure must be placed in between the grate and the ledge upon which the grate is designed to sit. Such prior art filter structures are exemplified by U.S. Pat. No. 5,223,154 to MacPherson, entitled System For Filtering Liquids In A Catch Basin Using Filters In Series And Overflow Channels; U.S. Pat. No. 5,372,714 to Logue, entitled Storm Sewer Catch Basin And Filter and U.S. Pat. No. 5,284,580 to Shyh, entitled Refuse Collecting Frame For Sewer. One of the problems associated with such prior art filter structures is that the presence of the filter structure under the grate prevents the grate from seating properly onto the ledge at the top of the catch basin. As a result, the grate is held above its normal height, which may cause the grate to protrude above street level. If the grate does extend above street level, the grate becomes a tripping hazard. Furthermore, the grate can be caught by street plows and car tires, wherein the grate can be damaged or accidentally moved out of place.

U.S. Pat. No. 5,849,198 to Sharpless, the same inventor as herein, discloses a new filter system for storm drains that eliminates the disadvantages of the prior art filter systems mentioned above. The Sharpless system uses a filter assembly that is suspended below the grate of a storm sewer. Within the filter assembly is a disposable oil absorbing filter. The present invention is an improved embodiment of the disposable oil absorbing filter, the composition of which is described and claimed below.

SUMMARY OF THE INVENTION

The present invention is a disposable filter cartridge for a storm drain and the filter system that uses the improved filter cartridge. The filter cartridge has a pillow structure, wherein a water permeable scrim bag surrounds loose oil absorbing fibers. The oil absorbing fibers are preferably fabricated from melt blown polypropylene. The filter cartridge is placed in a filter cage that directs water flow through the filter cartridge yet prevents debris from reaching the filter cartridge. The filter cage is suspended below the grate of the storm drain by suspension elements such as chains or rods. The top of each of the suspension elements terminate at an attachment element that engages the grate of the storm grate. As a result, the filter cage and filter cartridge are suspended directly from the storm drain grate. By suspending the filter cartridge directly from the grate of a storm drain, the filter cartridge is positioned directly in line with the flow of water entering the storm drain. Furthermore, by suspending the filter cartridge from the grate, the designed orientation of the grate is not disturbed and the grate remains at or below street level.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention oil absorbing filter cartridge can be used in many different types of storm drain filter assemblies, the filter cartridge is particularly well suited for use in curb side storm drains that are commonly designed into the sides of paved streets. As a result, by way of example, the present invention filter apparatus will be described in conjunction with a typical curb side storm drain in order to set forth the best mode contemplated for the present invention.

Figure 1:
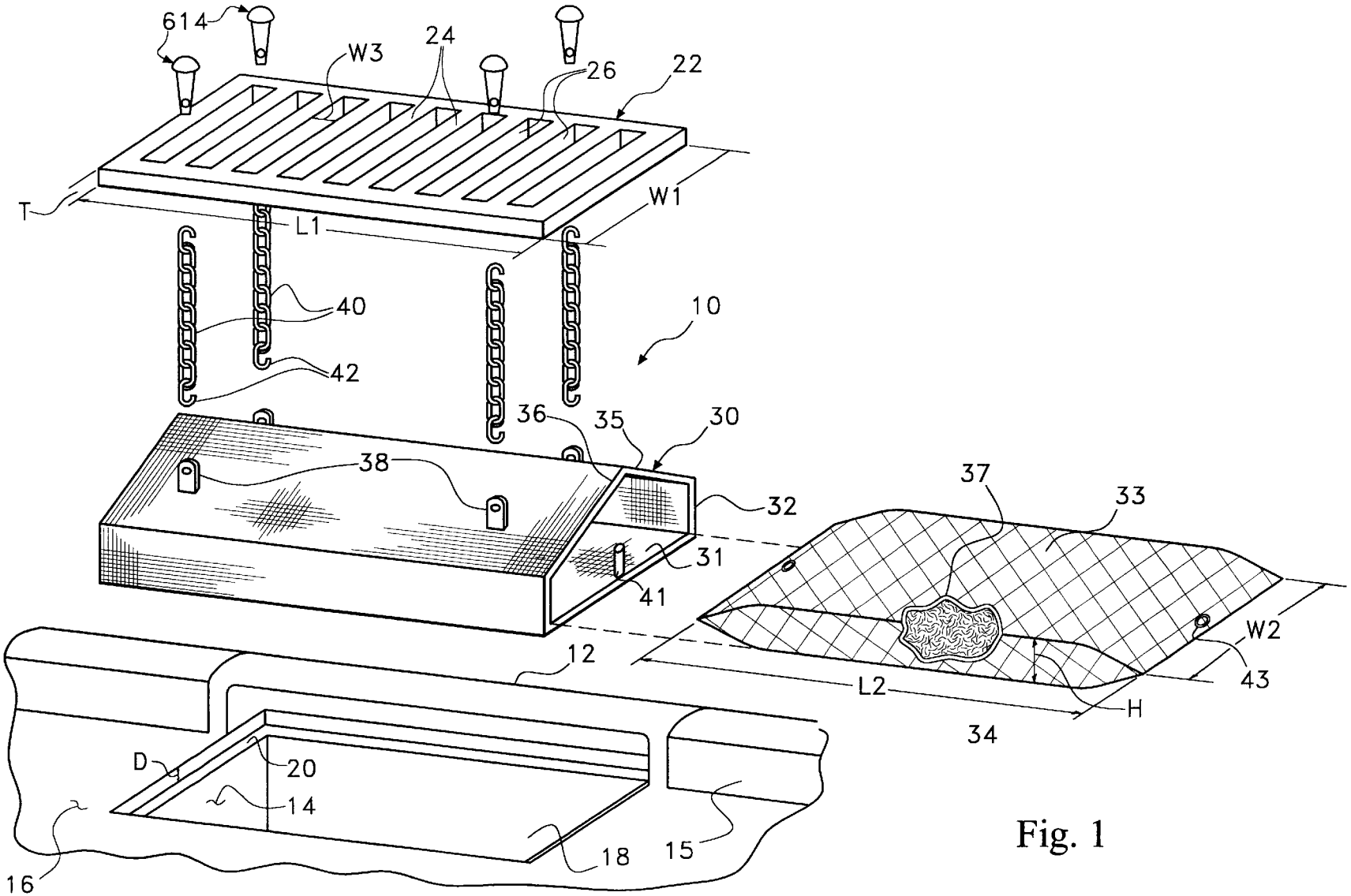
FIG. 1 is an exploded perspective view of an exemplary embodiment of a filter apparatus, in accordance with the present invention, shown in conjunction with a typical prior art storm drain.
Figure 2:
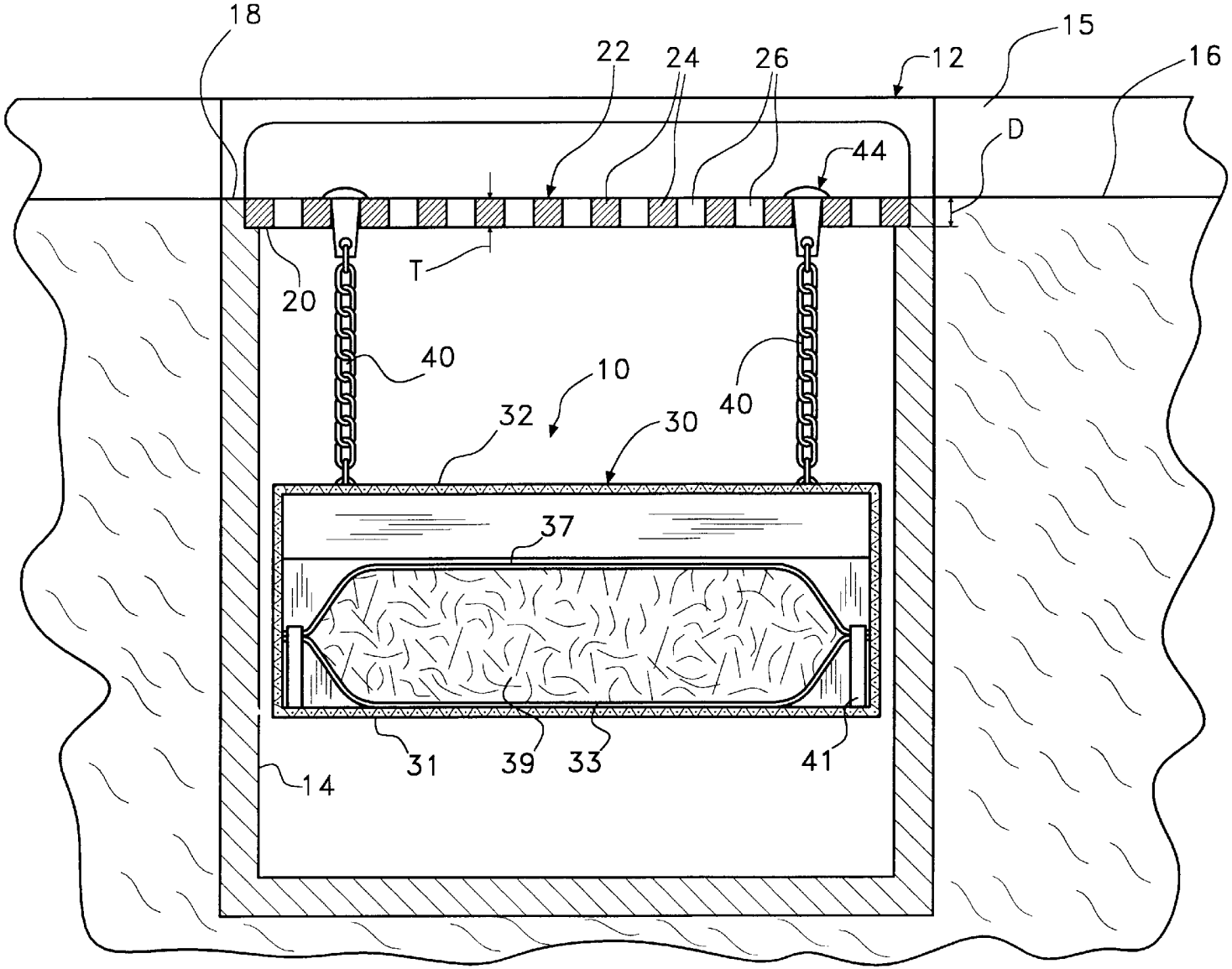
FIG. 2 is a cross-sectional view of the embodiment of the filter apparatus and storm drain shown in FIG. 1, viewed along section line 2—2.

Referring to FIG. 1 in conjunction with FIG. 2, a first exemplary embodiment of a storm drain filter assembly 10 is shown that is used to support the present invention oil absorbing filter cartridge 33. The storm drain filter assembly 10 is placed within a common curb side storm drain 12. The storm drain 12 contains a cement catch basin 14 that lays below the plane of a paved street 16 at a point near the curb 15 of the street 16. The catch basin 14 has an open top 18 that terminates at street level. A ridge 20 is formed on the interior of the catch basin 14 a short distance D below the open top 18 of the catch basin 14.

A grate 22 is provided that covers the open top 18 of the catch basin 14. The grate 22 is typically a cast metal structure having numerous parallel slats 24, whereby water is free to flow through the slots 26 that exist in between each of the parallel slats 24. The grate 22 has a length L1 and a width W1 (FIG. 1) that enables the grate 22 to pass through the open end 18 of the catch basin 14. However, the grate 22 is not small enough to pass the ridge 20 in the catch basin 14. Rather, the peripheral edges of the grate 22 abut against the ridge 20 and evenly support the grate 22 in a horizontal plane. The grate 22 has a thickness T that matches the depth D of the ridge 20 below street level. As a result, when the grate 22 is placed onto the ridge 20 in the catch basin 14, the top surface of the grate 22 is supported at approximately the same level as the street 16.

A filter cage 30 is suspended below the grate 22 within the confines of the catch basin 14. The filter cage 30 is comprised of a wire mesh frame 32. The wire mesh frame 32 defines a flat base shelf 31 and two top surfaces 35, 36 that are suspended above the flat base shelf 31. The flat base shelf 31 lays in the horizontal. The top surfaces 35, 36 (FIG. 1) of the wire mesh frame 32 are preferably angled at an acute angle relative the horizontal. The angle of the top surfaces 35, 36 causes large debris to slide off the filter cage 30 and pass into the bottom of the catch basin 14, where such debris is periodically removed during the scheduled maintenance of the storm drain 12. As such, the sloped top surfaces 35, 36 of the wire mesh frame 32 prevent the filter cage 30 from being obstructed by collected debris.

An oil absorbing filter cartridge 33 is placed within the filter cage 30 on the flat base shelf 31 of the cage. In this position, the filter cartridge 33 is positioned directly below the sloped top surfaces 35, 36 of the filter cage 30. The filter cartridge 33 covers the full area of the flat base shelf. In the preferred embodiment, the filter cartridge 33 has a length L2 of between twenty inches and fifty inches, a width W2 of between twelve inches and thirty inches, a height H of between two inches and eight inches. The size of the filter cartridge 33 is selected to fit the filter cage 30, and the filter cage 30 is selected to fit the storm sewer catch basin.

The filter cartridge 33 receives any water that pours through the filter cage 30. The filter cartridge 33 has a pillow construction. That is, the filter cartridge 33 is comprised of an outer scrim bag 37 that confines a loosely bound filter material 39. The scrim bag 37 is made of a synthetic material having hydrophobic properties. The material is manufactured in such a manner so as to define voids in the material sufficient enough in size for water to readily pass. In this manner, the scrim bag 37 does not itself absorb water, and is porous enough to enable water to freely flow through its structure. Suitable materials for the scrim bag 37 include, but are not limited to, Dacron and non-woven polyester felt.

The filter material 39 contained within the scrim bag 37 is a material that absorbs the oil that is mixed within the run-off water. Thus the filter material 39 removes oil from the water passing through the filter cartridge 33. The oil absorbing filter material 39 has both lipophilic properties and hydrophobic properties. Thus, the filter material 39 absorbs oil contained in the run-off water, yet does not absorb the water itself. Suitable filter material 39 for use in the filter cartridge 33 includes melt blown polypropylene fibers. Melt blown polypropylene fibers have the appearance and texture of cotton. The loose fibers of the melt blown polypropylene fibers enable the fibers to be densely packed onto the scrim bag 37 without significantly effecting the water permeability of the overall filter cartridge 33. Polypropylene fibers are commercially sold under the tradename BoniFibers® by BPM, Inc. of New Castle Del.

There are materials other than melt blown polypropylene fibers that have hydrophobic and lipophilic properties. Any such material can be adapted for use in the present invention, provided the material is effective in removing oil from water while permitting a significant water flow rate through the material.

Within the filter cage 30 are disposed hook mounts 41. The hook mounts 41 engage grommets 43 (FIG. 1) formed in the filter cartridge 33. The interconnection of the hook mounts 41 to the grommets 43 holds the filter cartridge 33 in place as run off water surges through the filter cartridge 33.

Connection brackets 38 (FIG. 1) are disposed on the sloped top surfaces 35, 36 of the filter cage 30. The connection brackets 38 are anchored to the wire mesh frame 32 of the filter cage 30 in such a manner that the entire weight of the filter cage 30 can be supported by the connection brackets 38. Suspension elements, such as chains 40 or rods, are used to suspend the filter cartridge 30 below the grate 22 of the storm drain 12. Chains 40 are described by way of example. The bottom of each of the chains terminates with a hook 42 (FIG. 1) or similar configuration that enables the chains 40 to be mechanically attached to the connection brackets 38 on the top of the filter cage 30. The chains 40 attach to the filter cage 30 in a removable manner. As such, the filter cage 30 can be removed from the chains 40 and replaced periodically.

The top end of each of the chains 40 attaches to an element that engages the grate 22 of the storm drain 12. In the shown embodiment, a wedge element 44 is used to interconnect the chains 40 with the grate 22.

Referring to FIG. 1, it can be seen that in order to remove the filter cage 30 and replace the filter cartridge, the grate 22 of the storm drain 12 is engaged and lifted upwardly away from the catch basin 14. Since the filter cage 30 is suspended from the structure of the grate 22, the filter cage 30 lifts up and out of the catch basin 14 as the grate 22 is removed. Once the grate 22 and filter cage 30 are removed, the filter cartridge 33 can be replaced by removing the old filter cartridge from the filter cage 30 and replacing it with a new clean filter cartridge. The oil soaked old cartridge can then be either sent to a recycling plant for oil extraction or can be disposed of in an environmentally safe manner.

When storm drains are cleaned, the grate of the storm drain must be removed. Maintenance personnel therefore have the equipment needed to remove the grates from storm drains. As such, a maintenance team during the normal maintenance of the storm drain can easily replace old filter cartridges or add a new filter cartridge to a storm drain not previously containing a filter cartridge.

It will be understood that the embodiment of the present invention described and illustrated herein is merely exemplary and a person skilled in the art can make many variations to the embodiment shown without departing from the scope of the present invention. It should also be understood that the various elements from different embodiment can be mixed together to create alternate embodiments that are not specifically described. All such variations, modifications and alternate embodiments are intended to be included within the scope of the present invention as defined by the appended claims.

What is claimed is:

1. In a storm drain having a catch basin and a grate that covers the catch basin, a filter assembly comprising:

at least one grate engagement element for mechanically engaging the grate;

a suspension element coupled to each said grate engagement element, wherein each said suspension element extends downwardly from each said grate engagement element;

a cage coupled to each said suspension element, each suspension element acting to suspend said cage a predetermined distance below the grate, wherein said cage has a flat base surface, at least one top surface that faces the grate of the storm drain, two closed sides and two opposing open sides that define an interior area accessible through said two opposing open side surfaces;

mounting elements disposed in said cage at points proximate said two opposing open side surfaces; and a replaceable filter cartridge selectively positionable in said cage, said filter cartridge being water permeable and having oil absorbing properties, wherein said mounting elements engage said replacement filter and retain said replacement filter in a fixed position within said cage.

2. The apparatus according to claim 1, wherein said at least one top surface is sloped to prevent debris from collecting thereon.

3. The apparatus according to claim 1, wherein said filter cartridge includes a scrim bag made of synthetic material with hydrophobic properties and a volume of oil absorbing material retained within said scrim bag, wherein said oil absorbing material has hydrophobic properties yet is highly porous so as to permit the flow of water therethrough.

4. The apparatus according to claim 3, wherein said filter cartridge includes polypropylene fibers.

5. The apparatus according to claim 4, wherein said polypropylene fibers are melt blown.

6. The apparatus according to claim 3, further including mounting grommets disposed in said scrim bag, wherein said mounting elements selectively engage said grommets and retain said filter cartridge in said fixed position within said cage.

7. The apparatus according to claim 3, wherein said scrim bag is made of synthetic material selected from a group consisting of non-woven polyester felt and Dacron.

8. The apparatus according to claim 1, wherein said filter cartridge has a length between twenty inches and fifty inches, a width of between twelve inches and thirty inches, a height of between two inches and eight inches.

9. A storm drain apparatus, comprising:

a catch basin having an open top;

a removable grate covering said open top of said catch basin, wherein said grates defines a plurality of slats through which water can flow;

a filter cage, wherein said cage has a flat base surface, at least one top surface that faces the grate of the storm drain, two closed sides and two opposing open sides that define an interior area accessible through said two opposing open side surfaces;

mounting elements disposed in said cage at points proximate said two opposing open side surfaces;;

a disposable filter cartridge, wherein said mounting elements engage said filter cartridge and retain said filter cartridge in a fixed position within said cage;

at least one suspension element having a first end and a second end, wherein the first end of each suspension element is coupled to said grate and said second end of each suspension element is coupled to said filter cage, thereby suspending said filter cage below said grate so that most water flowing through said grate passes through said filter cage and said filter cartridge.

10. The apparatus according to claim 9, wherein said filter cartridge contains an oil absorbing material.

11. The apparatus according to claim 10, wherein said oil absorbing material includes polypropylene fibers.

12. The apparatus according to claim 10, wherein said polypropylene fibers are melt blown.

13. The apparatus according to claim 9, further including mounting grommets disposed in said filter cartridge, wherein said mounting elements selectively engage said grommets and retain said filter cartridge in said fixed position within said filter cage.

* * * * *